US006557945B1

(12) United States Patent
Eric

(10) Patent No.: US 6,557,945 B1
(45) Date of Patent: May 6, 2003

(54) TABLET CUTTER

(75) Inventor: Chue Lap-Fu Eric, Tai Po (HK)

(73) Assignee: Pharmadesign, Inc., Warren, NJ (US)

( * ) Notice: Subject to any disclaimer, the term of this patent is extended or adjusted under 35 U.S.C. 154(b) by 0 days.

(21) Appl. No.: 10/015,810

(22) Filed: Nov. 2, 2001

(51) Int. Cl.[7] ..... B25F 3/00
(52) U.S. Cl. ..... 300/124
(58) Field of Search ..... 30/124, 120.1; 225/93, 103, 104; 241/DIG. 27

(56) References Cited

U.S. PATENT DOCUMENTS 4,179,806 A * 12/1979 Lieptz ..... 30/124
4,473,192 A * 9/1984 Urban et al. ..... 225/103
4,697,344 A * 10/1987 Leopoldi ..... 30/124
4,824,000 A * 4/1989 Baxter et al. ..... 225/103
4,887,755 A * 12/1989 Gibilisco ..... 225/103
4,903,877 A * 2/1990 Hnatuk ..... 225/93
5,038,475 A * 8/1991 Wolff ..... 30/124
5,118,021 A * 6/1992 Fiocchi ..... 225/103
5,417,359 A * 5/1995 Zellner ..... 225/93
5,944,243 A * 8/1999 Weinstein ..... 225/93

* cited by examiner

*Primary Examiner*—Hwei-Siu Payer
(74) *Attorney, Agent, or Firm*—Watov & Kipnes, P.C.

(57) ABSTRACT

A tablet cutter including a tablet supporting assembly and a tablet cutting assembly secured to the tablets supporting assembly and which includes a blade holder which is movable by the action of a cam follower on an axially extending arm of the blade holder to provide accurate and safe cutting of tablets in which the tablet cutter can accommodate a wide variety of shapes and sizes of tablets.

6 Claims, 5 Drawing Sheets

TABLET CUTTER

FIELD OF THE INVENTION

The present invention is directed to a device for accurately and efficiently cutting tablets into parts more suitable for swallowing or to effect a reduced dosage.

BACKGROUND OF THE INVENTION

The present invention is generally directed to a tablet cutter which effectively cuts a tablet into smaller pieces while eliminating or minimizing crumbling of the tablet. The tablet cutter also prevents accidental contact with the blade during the cutting operation.

It is well recognized that some tablets are either difficult to swallow because of their relatively large size or contain an amount of an active ingredient which is beyond what the user is required to take at a particular time. In either case, it is desirable to be able to cut the tablet into two or more smaller portions. One of the problems associated with cutting tablets is their tendency to crumble when any pressure is exerted thereon. A desirable tablet cutter is capable of providing a swift, uniform cut without causing crumbling.

Another problem associated with tablet cutters is that quite often they are difficult to manipulate by the user. This is particularly important with elderly or infirm people who may have problems with manual dexterity.

In addition, some tablet cutters are designed to cut only one size tablet or do not readily accommodate more than one size or shape of tablets. Still further, some tablet cutters have an exposed blade which can present a hazard to the user during the cutting operation.

While there have been numerous attempts at producing tablet cutters for the purposes intended herein, such tablets cutters tend to suffer from one or more of the disadvantages mentioned above. By way of example, tablet cutters and related devices are disclosed in Heitzman (U.S. Pat. No. 3,650,445); Stevens (U.S. Pat. No. 3,815,802); Leopoldi et al. (U.S. Pat. No. 4,173,826); Urban et al. (U.S. Pat. No. 4,409,843); Hoeks et al. (U.S. Pat. No. 4,422,553); Urban et al. (U.S. Pat. No. 4,473,192); Leopoldi (U.S. Pat. No. 4,697,344); Hnatuk (U.S. Pat. No. 4,903,877); Hnatuk (U.S. Pat. No. 4,964,555); Wolff (U.S. Pat. No. 5,038,475); Zellner (U.S. Pat. No. 5,417,359); and Weinstein (U.S. Pat. No. 5,944,243).

It would therefore be a significant advance in the art to provide a table cutter which can securely cut a tablet substantially without the risk of crumbling, which can accommodate different size and shape tablets, which is safe and effective to use and which preferably has a shape which can be easily operated within the palm of the user's hand without undesirable contact of the blade during the cutting operation.

SUMMARY OF THE INVENTION

The present invention is generally directed to a tablet cutter which safely and effectively cuts tablets without crumbling and which can be readily operated by the user in the palm of the hand. The present tablet cutter can also accommodate different size and shape tablets and provides a tablet cutting assembly which prevents unintentional contact with the blade during the cutting operation.

In a particular aspect of the present invention, there is provided a tablet cutter comprising:

a) a base having an upper surface;

b) a tablet supporting assembly mounted on the upper surface of the base and comprising at least one tablet supporting slot for supporting a tablet in a cutting position;

c) a tablet cutting assembly operatively secured to the base and movable from a first position for enabling a tablet to be inserted into the tablet supporting assembly to a second position for cutting the tablet, said tablet cutting assembly comprising;

1) a blade holder having a blade mounted thereon, said blade being aligned with the tablet supporting slot so that the blade may contact and cut the tablet, and an axially extending arm, 2) a pair of opposed supports for pivotally supporting the blade holder within the tablet cutting assembly, and 3) a cam follower secured to the base of the tablet supporting assembly for contacting the axially extending arm of the blade holder and urging the tablet cutting assembly from the first to the second position.

BRIEF DESCRIPTION OF THE DRAWINGS

The following drawings in which like reference characters indicate like parts are illustrative of embodiments of the invention and are not intended to limit the invention as encompassed by the claims forming part of the application.

DETAILED DESCRIPTION OF THE INVENTION

The present invention is directed to a tablet cutter which employs a base and a tablet supporting assembly mounted to the base and which includes at least one slot for supporting a tablet in a cutting position. There is provided a tablet cutting assembly which is operatively secured to the base and movable by the action of a cam follower on an axially extending arm of a blade holder in a manner which prevents unwanted contact with the cutting blade by the user. The present tablet cutter can provide easy and safe cutting of tablets in a manner which can be readily handled by even those users having deficient manual dexterity. The tablets are cut without crumbling and the tablet cutter is readily adapted to cutting multiple tablets of the same shape and size or different size and shape tablets at the same time.

Figure 1:
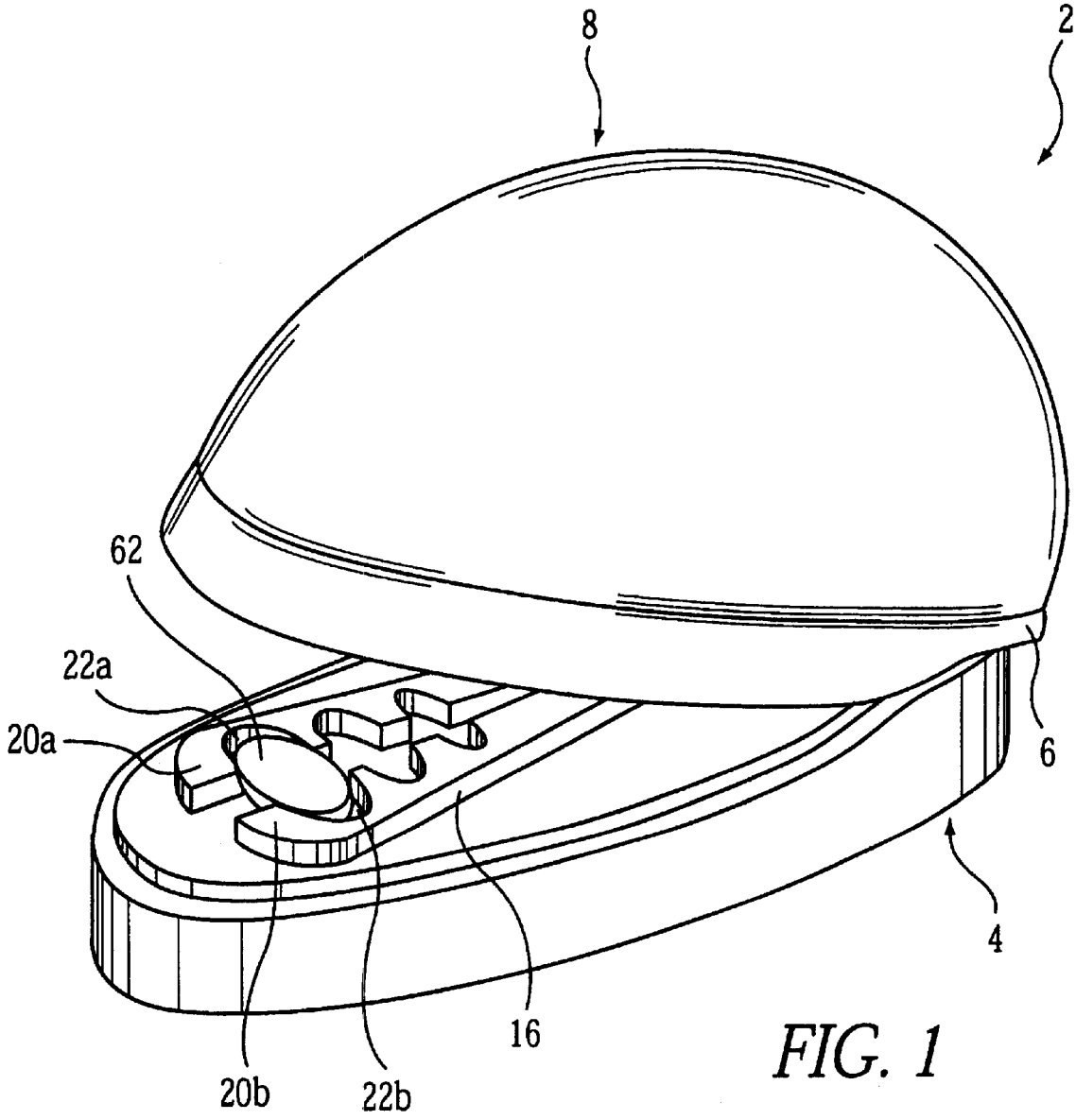
FIG. 1 is a perspective view of one embodiment of the tablet cutter of the present invention.
Figure 4:
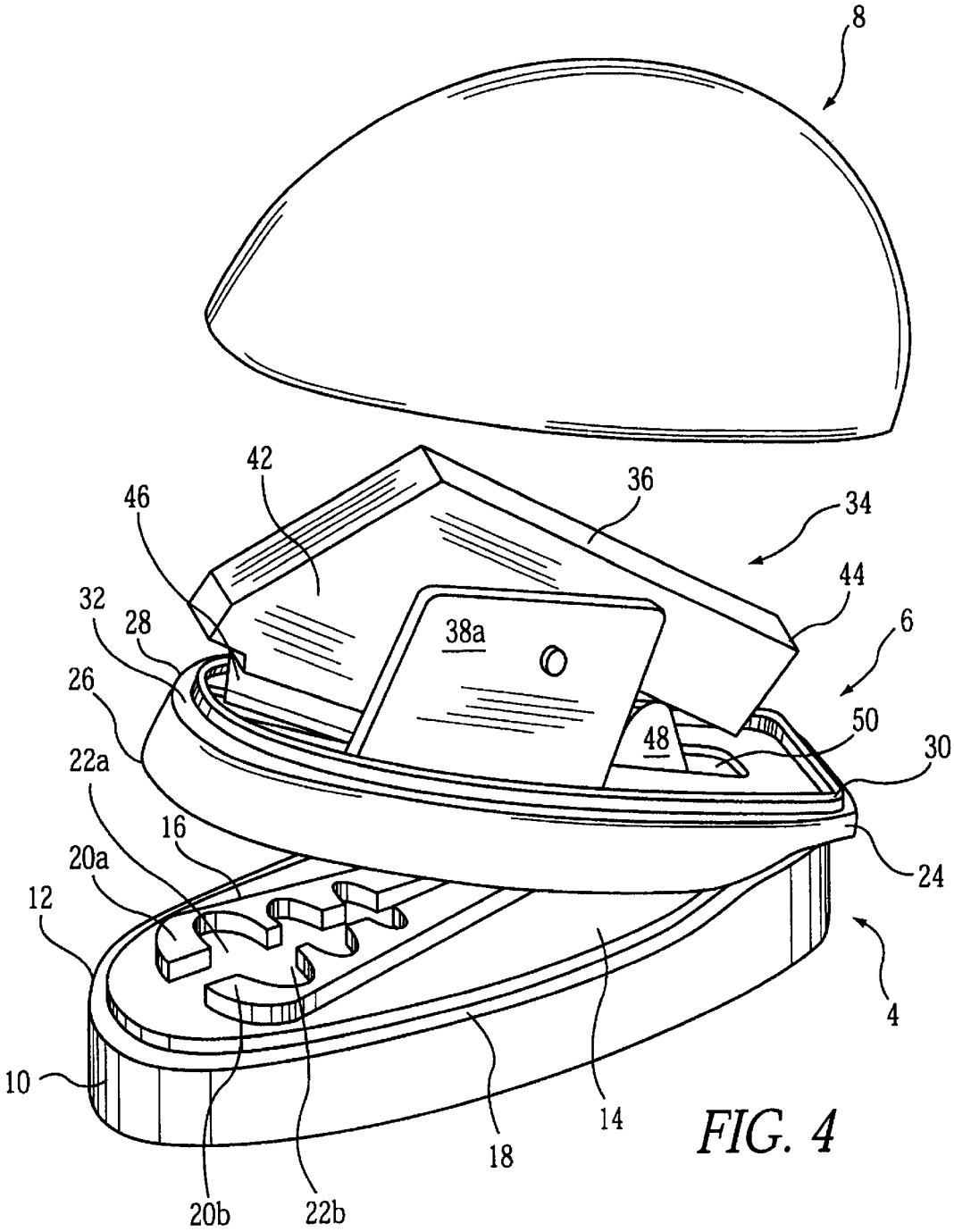
FIG. 4 is a perspective elevational view of the embodiment of FIG. 1 with the tablet cutting assembly in position enabling a tablet to be inserted into a tablet supporting slot.
Figure 5:
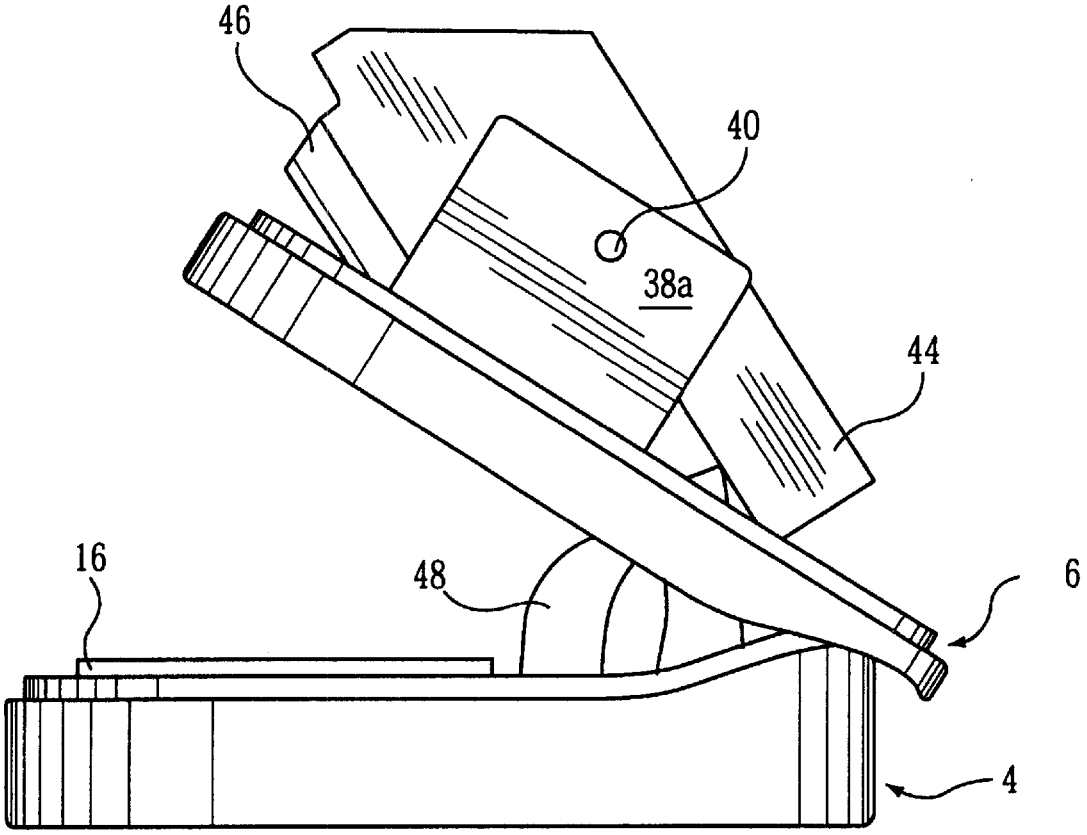
FIG. 5 is a side elevational view of the embodiment shown in FIG. 4.

Referring to the drawings and particularly to FIGS. 1, 4 and 5, the tablet cutter 2 includes a tablet supporting assembly 4 providing a place for securing individual tablets prior to cutting and during the cutting operation. As shown best in FIG. 4, there is also provided a tablet cutting assembly 6 which cooperates with the tablet supporting assembly and provides a cutting mechanism which uniformly cuts a tablet supported on the tablet supporting assembly 4 without crumbling and without endangering the user. There is also provided as part of the tablet cutter 2, a lid 8 which is releasably secured to the tablet cutting assembly 6 to protect the user during operation of the table cutter 2 and when the same is not in use.

Figure 2:
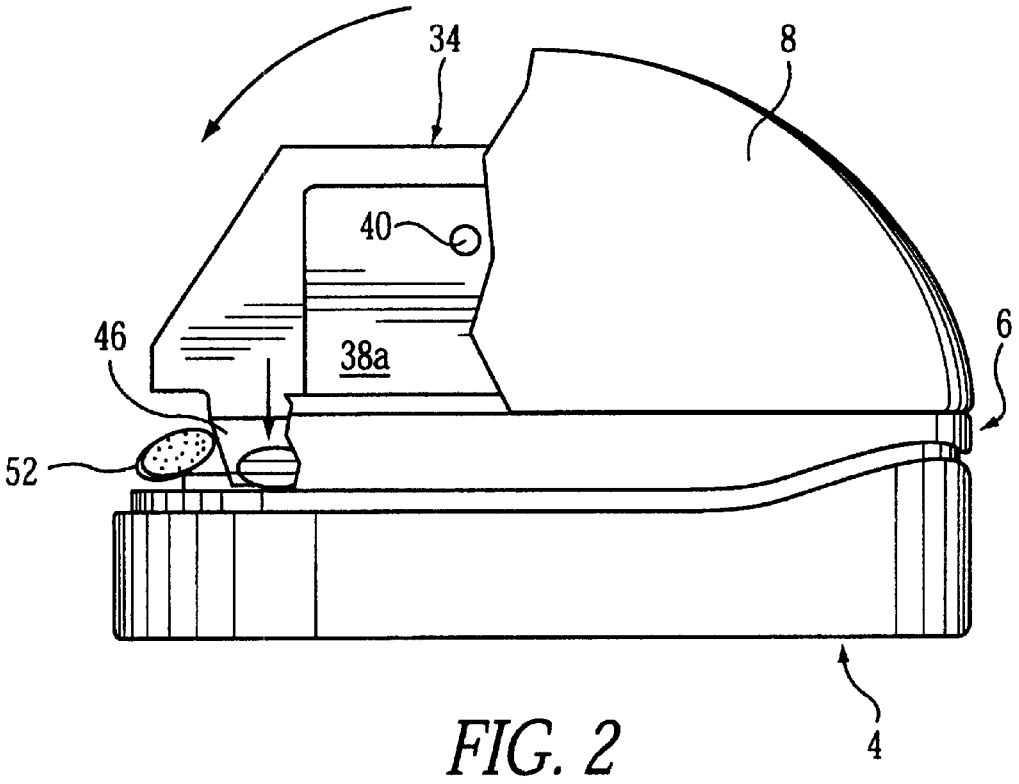
FIG. 2 is a side elevational view of the tablet cutter shown in FIG. 1 with the blade in the cutting position.

The tablet supporting assembly 4 includes a base 10 having an upper surface 12 which has thereon a platform 14 on which is secured a tablet supporting member 16. Between the edge of the upper surface 12 and the platform 14 is a ridge 18 which supports the tablet cutting assembly in the cutting position as shown in FIG. 2 and when the same is not being used and the lid 8 is secured thereover.

The tablet supporting member 16 comprises a pair of mirror-image supports 20*a* and 20*b* having cutouts 22*a* and 22*b*, each defining one-half of a tablet such that when the tablet supports 20*a* and 20*b* are in an operable position for supporting a tablet, the tablet securely fits within the opposed cutouts 22*a* and 22*b*.

The tablet supporting member 16 can provide tablet supports 20*a* and 20*b* which have a single pair of cutouts 22*a* and 22*b* or multiple pairs of cutouts as specifically shown in FIG. 4. The size and shape of the multiple cutouts can be the same so as to enable the support and cutting of multiple tablets of the same shape and size. Alternatively, the multiple pairs of cutouts can define different shapes and/or sizes so as to enable multiple tablets of different sizes to be cut one at a time or together.

The positioning of the tablet supporting member 16 is such that the center of the supported tablet or tablets is in a position directly in the path of the tablet cutting assembly 6 as described hereinafter.

The tablet cutting assembly 6 employs a base 24 having a lower edge 26 which contacts the ridge 18 of the tablet supporting assembly 4 when the tablet cutter 2 is in the cutting position. The base also has an upper surface 28 and an upwardly extending wall 30. Between the edge of the upper surface 28 and the wall 30 is a ridge 32 which is contacted by the lid 8 when the same is positioned on top of the tablet cutter 2 to thereby cover the tablet cutting assembly 6.

The tablet cutting assembly 6 also includes a cutting mechanism shown generally by numeral 34. The cutting mechanism includes a blade holder 36 pivotally supported by a pair of blade holder supports 38*a* and 38*b* through a common rod 40. The blade holder 36 can be moved from a non-cutting position to a cutting position as explained hereinafter through partial rotation about the rod 40.

The blade holder 36 has a body portion 42 and a rearward, axially extending arm 44. At the bottom of the body portion 42 of the blade holder 36 there is provided a slot (not shown) for securing a cutting blade 46 therein.

Figure 3:
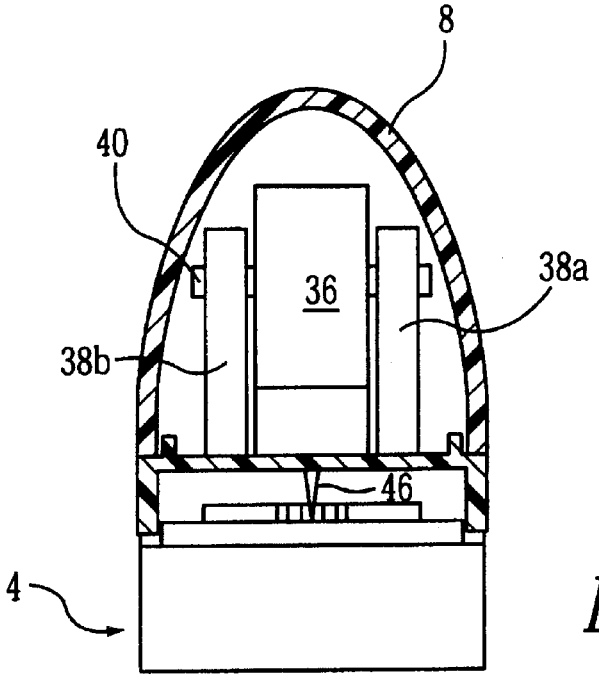
FIG. 3 is a cross-sectional view of the tablet cutter of FIG. 1.

Movement of the tablet cutting assembly 6 from a non-cutting position as shown in FIG. 5 to a cutting position as shown in FIGS. 2 and 3, is facilitated by a cam follower 48 secured to the platform 14 on the tablet supporting assembly 4. The cam follower 48 is in operative contact with the under surface of the axially extending arm 44 of the blade holder 36. The shape of the cam follower 48 is designed so that the blade holder 36 is movable from a non-cutting position as shown in FIG. 5 to a cutting position as shown in FIG. 2 when the user exerts force on the lid 8 in a downward motion as shown by the arrow in FIG. 2. The downward motion exerted by the user is through contact with the upper surface of the lid 8 and therefore away from the cutting blade 46 thus preventing direct contact by the user.

In order to enable the cam follower 48 to operatively engage the axially extending arm 44 of the blade holder 36 and for the blade holder 36 to contact the tablets contained in the tablet supporting member 16, an axially extending opening is provided in the base 24 of the tablet cutting assembly 6 as identified by numeral 50. The opening 50 is of sufficient length to enable the cam follower 48 to extend therethrough into operable contact with the axially extending arm 44 and for the blade 46 to proceed therethrough into contact with the tablets supported on the tablet supporting assembly 4.

Movement of the tablet cutting assembly 6 into operative engagement with the tablets contained in the tablet supporting assembly 4 is facilitated, preferably, by providing a pivotal connection between the tablet supporting assembly 4 and the tablet cutting assembly 6 at the end thereof remote from where the tablets are positioned. As shown, for example, in FIGS. 1, 4 and 5. The pivotal connection (not shown) can be by any convenient pivotal connecting assembly such as providing a rod at the rear of the tablet cutting assembly 6 and a corresponding channel in the tablet supporting member 4 so that the rod can rotate within the channel.

Figure 6:
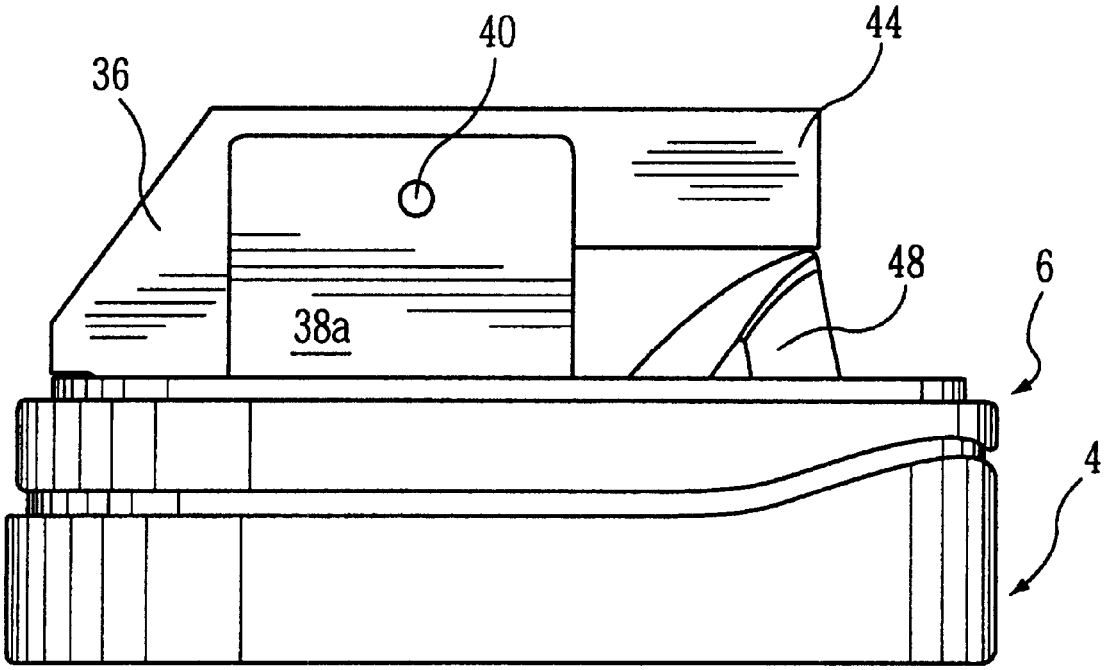
FIG. 6 is a side view of the tablet cutter of FIG. 1 in the tablet cutting position in the absence of the lid so as to show the tablet cutting assembly.

In operation by reference of FIGS. 1–6, the table cutter 2 of the present invention has the tablet cutting supporting assembly 4 and the tablet cutting assembly 6 positioned as shown in FIG. 6 with the lid 8 (see FIG. 1) secured to the tablet cutting assembly 6.

The lid 8 and the tablet cutting assembly 6 are pivotally moved rearwardly by the user as shown in FIG. 1 to expose the tablet supporting assembly 4 so that a tablet 52 may be positioned within a pair of cutouts 22*a* and 22*b* of the tablet supports 20*a* and 20*b* of the tablet supporting member 16.

Once the tablet 52 is suitably positioned, the tablet supporting assembly 4 and the tablet cutting assembly 6 are essentially in the position shown in FIG. 5. When pressure is exerted on the lid 8 as shown in FIG. 2 by the user pressing his or her palm downwardly on the lid, thereby moving the tablet cutting assembly 6 downwardly, the axially extending arm 44 engages the cam follower 48 in such a manner that the blade holder 36 begins to move downwardly in the direction of the tablet 52 positioned in the tablet supporting assembly 4. As pressure is further exerted by the user on the lid 8 as shown in FIG. 2, the blade 46 contacts the tablet 52 and cuts the same in half because the blade 46 and the tablet 52 are aligned in a manner to accomplish this purpose. The entire motion of the tablet cutting assembly 6 as described above is accomplished while the user's hand is away from the cutting blade. Once the tablet is cut, the user reverses the motion of the lid and pulls back the tablet cutting assembly 6 to thereby enable access to the tablet 52 and its two evenly divided portions (see FIG. 2).

It will be understood that the blade holder 36 can be permanently secured to the platform 14 of the base 10 or may be releasably secured thereto so that additional tablet supporting members 16 may be placed within the tablet cutter 2. The tablet supporting members 16 can be releasably secured in a number of ways through the use of releasable pressure sensitive adhesives, or by providing an indentation within the platform 14 to enable the tablet supporting member to be secured on the platform 14 and then readily removed therefrom. The use of releasable tablet supporting member 16 can enable the tablet cutter to accommodate a wide variety of tablet shapes and sizes so that a single tablet cutter can in principle be used to cut any tablet that may be required by the user.

It will be understood that other embodiments and further modifications of the invention which are within the ordinary skill of the art are included herein.

What is claimed is:

1. A tablet cutter comprising:

a) a base having an upper surface;

b) a tablet supporting assembly mounted on the upper surface of the base and comprising at least one tablet supporting slot for supporting a tablet in a cutting position;

c) a tablet cutting assembly operatively secured to the base and movable from a first position for enabling a tablet to be inserted into the tablet supporting assembly to a second position for cutting the tablet, said tablet cutting assembly comprising;

1) a blade holder having a blade mounted therein, said blade being aligned with the tablet supporting slot so that the blade may contact and cut the tablet and an axial extending arm, 2) a pair of opposed supports for pivotally supporting the blade holder within the tablet cutting assembly, and 3) a cam follower secured to the tablet supporting assembly for contacting the axial extending arm of the blade holder and urging the tablet cutting assembly to said second position.

2. The tablet cutter of claim 1 comprising a plurality of tablet support slots.

3. The tablet cutter of claim 2 wherein the tablet supporting slots are dimensioned to receive different sized tablets.

4. The tablet cutter of claim 1 wherein the tablet supporting assembly comprises a pair of shaped arms extending essentially parallel to each other, each arm comprising a cut out such that when the arms are placed side by side the cutouts of the arms together form said slot.

5. The tablet cutter of claim 1 wherein the tablet cutting assembly comprises a platform hingedly secured to the base, having a longitudinally extending opening therein, a front portion of the opening enabling the blade to pass through the platform to cut the tablet contained in the slot and a rear portion enabling the cam follower to contact the axially extending arm of the blade holder for urging the blade holder through the front portion of the opening.

6. The tablet cutter of claim 5 further comprising a cover removably secured to a platform for engaging the tablet cutting assembly upon the application of pressure exerted by a user.

* * * * *